United States Patent [19]

Itoh et al.

[11] 4,355,591

[45] Oct. 26, 1982

[54] NEEDLE THREADERS FOR A SEWING MACHINE

[75] Inventors: Minoru Itoh, Kisozaki; Toshio Sasaki, Inazawa, both of Japan

[73] Assignee: Brother Kogyo Kabushiki Kaisha, Japan

[21] Appl. No.: 270,140

[22] Filed: Jun. 3, 1981

[30] Foreign Application Priority Data

Jun. 24, 1980 [JP] Japan ..... 55-86033

[51] Int. Cl.[3] ..... D05B 87/02

[52] U.S. Cl. ..... 112/225

[58] Field of Search ..... 112/225, 224, 270; 223/99

[56] References Cited

U.S. PATENT DOCUMENTS

| | | | |
|---|---|---|---|
| 1,753,114 | 4/1930 | Fluharty | 112/225 |
| 2,910,029 | 10/1959 | Herbst | 112/225 |
| 3,289,902 | 12/1966 | Fritts | 223/99 |
| 3,486,472 | 12/1969 | Kaplan | 112/225 |
| 3,502,045 | 3/1970 | Hanyu | 112/225 |
| 3,517,631 | 6/1970 | Weber | 112/225 |
| 3,599,587 | 8/1971 | Greulich | 112/225 |

*Primary Examiner*—H. Hampton Hunter

*Attorney, Agent, or Firm*—Leydig, Voit, Osann, Mayer & Holt, Ltd.

[57] ABSTRACT

There is disclosed a needle threader comprizing a support provided with a needle accommodating notch and a thread guide groove, and a pair of resilient rollers rotatably mounted on the support and contacting at the respective peripheral edges with each other. In the needle threader, an eye of a needle accommodated in the needle accommodating notch is located on a tangent line passing through the contact portion of the pair of resilient rollers. A thread introduced via the thread guide groove towards the proximity of the contact portion of the pair of resilient rollers is gripped by and transferred through rotation of the resilient rollers, resulting in the thread being passed through the eye of the needle.

4 Claims, 7 Drawing Figures

NEEDLE THREADERS FOR A SEWING MACHINE

BACKGROUND OF THE INVENTION

This invention relates to a needle threader for a sewing machine adapted for threading the eye of a needle.

In the conventional needle threader, such as that disclosed in the U.S. Pat. No. 3,517,631, a thin and brittle threading hook is inserted through the needle eye and, after the thread is engaged at the hook, the hook is drawn out through the needle eye for passing the thread therethrough. With such known device, the hook may occasionally impinge on the peripheral portion of the needle eye during threading operation, often resulting in breakage of the brittle hook.

As another type of the conventional device, a pneumatic needle threader is also known as disclosed for example in the U.S. Pat. No. 3,486,472. This known device necessitates the use of pneumatic pump means and is therefore costly to manufacture.

Still another type of the prior art, such as disclosed in the U.S. Pat. No. 3,289,902, is also known wherein the thread is gripped along a predetermined straight thread path between a pair of interengaged blocks of flexible resilient material, and the needle is held with the needle eye in alignment with said thread path, said pair of blocks and the needle being moved relatively to each other for threading the eye of the needle. In this device, difficulties are encountered in aligning the needle eye with said thread path and thus reliable threading may not be assured.

There is also known in the prior art a further needle threading device comprises a plate member formed with a needle accommodating notch and a thread guide groove aligned with the eye of the needle accommodated in said notch, and a roller member of resilient and flexible material adapted for encircling the needle eye in cooperation with the plate member and for engaging with the thread inserted in said guide groove, said roller member being rotated to travel along said guide groove for transferring and passing the thread through the eye of the needle. In this device, the roller must be fabricated from highly resilient material and therefore has only poor durability.

SUMMARY OF THE INVENTION

The present invention has been made to obviate the above deficiency of the prior art and has it as an object to provide an improved needle threader which is durable and enables the thread to be passed easily and positively through the eye of the needle.

In order to fulfil such object, the needle threader of the present invention comprises a pair of resilient rollers that are rotatably mounted on a support having a needle accommodating notch and that contact at the respective peripheral edges with each other, the needle being accommodated in the notch with the eye of the needle positioned on the line passing through and tangent to the contact portion of the two resilient rollers. In the threading operation, the thread is introduced to the zone of proximity to the contact portion of the two resilient rollers through the aid of thread guide means so as to be gripped between said resilient rollers and transferred by rotation of these rollers so that the thread is passed through the eye of the needle.

According to a preferred embodiment of the present invention, one of the resilient rollers is driven by rotational operation of a knob mounted on the support, while the other roller is driven by such rotation of said one of the rollers. Thus, direct manipulation of the resilient rollers is dispensed with, thus resulting in perspiration etc. not being adhered to the rollers and the thread being positively moved towards the eye of the needle.

DESCRIPTION OF THE PREFERRED EMBODIMENT

Figure 1:
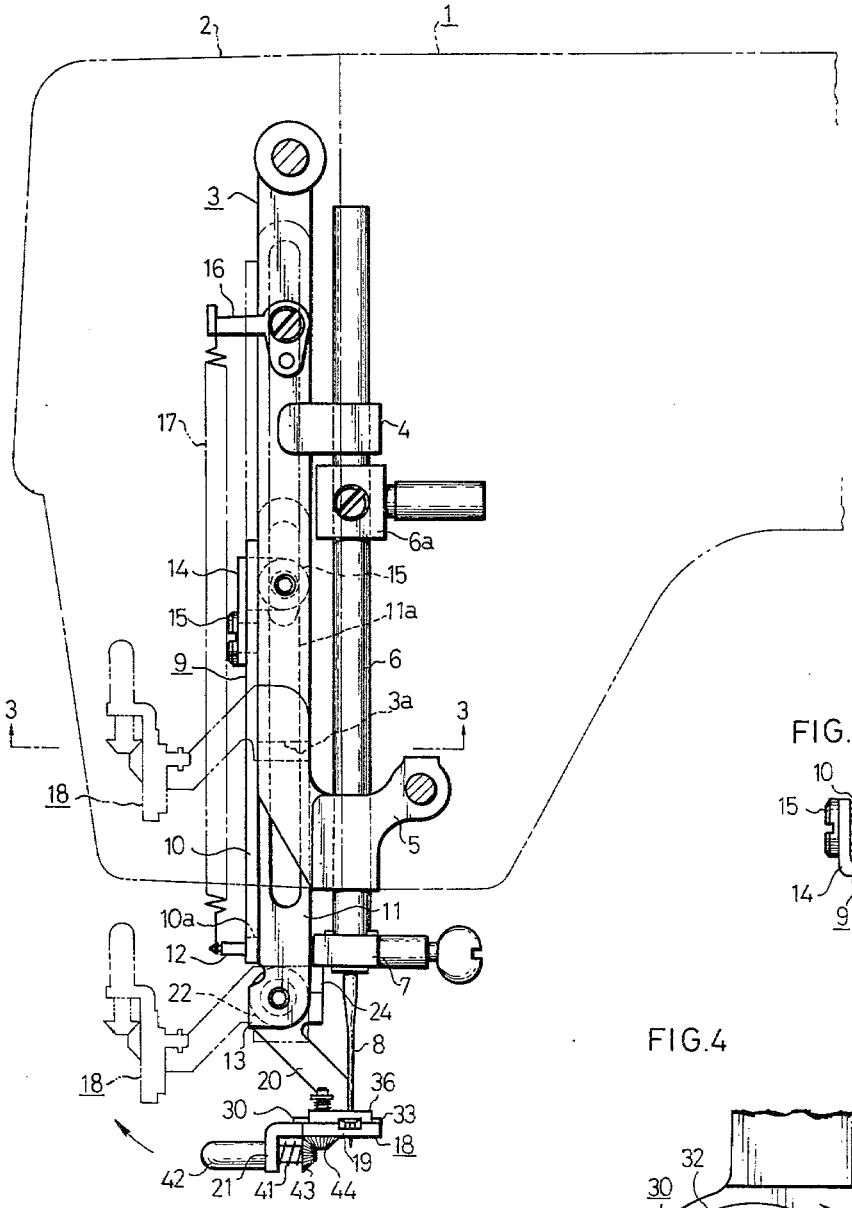
FIG. 1 is a front view of the sewing machine showing the needle threader of the present invention in the mounted state.
Figure 3:
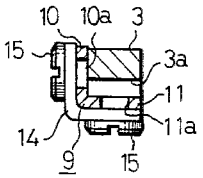
FIG. 3 is a section taken along line 3—3 of FIG. 1.
Figure 2:
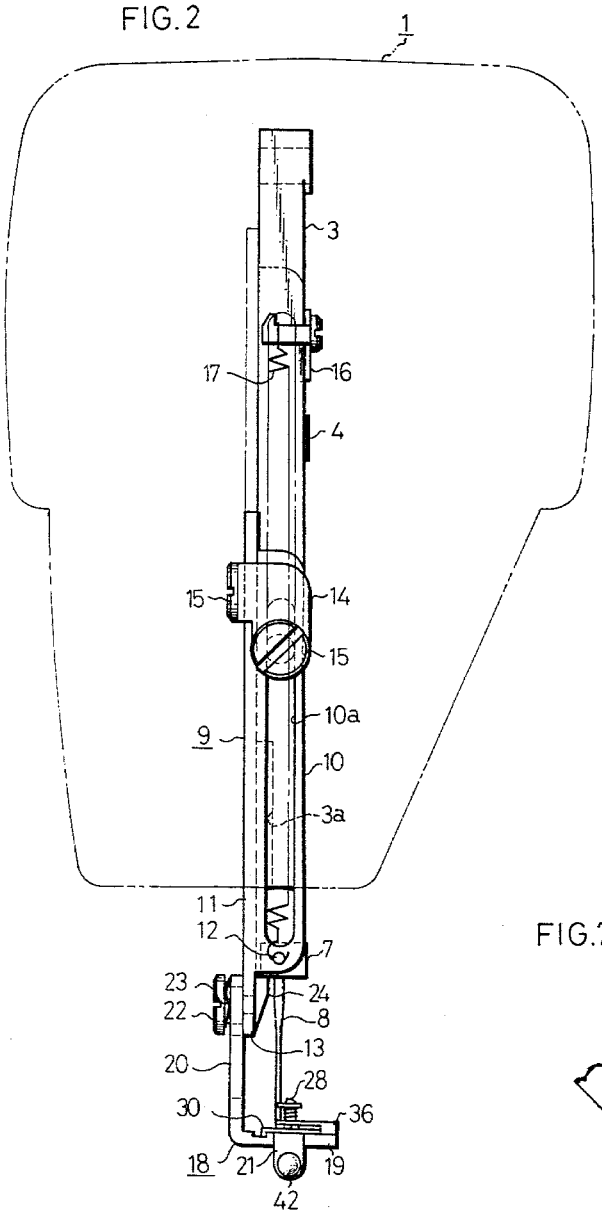
FIG. 2 is a left-hand side view thereof.

An embodiment of the present invention is explained below by referring to the accompanying drawings. A face plate 2 is hinged to the head portion of a machine frame 1 so that the inner part of the head portion may be exposed upon swinging of the face plate 2 towards its open position. A needle bar gate 3 having a substantially rectangular cross-section is mounted for swinging movement on the head portion of the frame 1, and is formed with a cutout 3*a* on the lower rear face thereof as shown in FIGS. 2 and 3. Projections 4 and 5 are provided to substantial the center and lower portion of the needle bar gate 3 respectively so as to project towards right as seen in FIG. 1. A jogging mechanism (not shown) as known per se is connected to the needle bar gate 3 at the lower projection 5 for causing the needle bar gate 3 to swing laterally.

A needle bar 6 is carried by the needle bar gate 3 at said projections 4 and 5 for vertical movement. A needle clamp 7 is mounted to the lower extremity of the needle bar 6. A needle 8 is removably mounted by the clamp 7 to the lower extremity of the needle bar 6 and formed with a needle eye 8*a* extending in the fore and aft direction. To approximately the center of the needle bar 6 is secured a needle bar clamp 6*a* through which the needle bar 6 may be vertically movable by a conventional crank mechanism (not shown).

A metallic plate member 9 is formed by bending so as to have a transverse section in the form of a letter L and thus has two flat portions 10 and 11 having longitudinal slots 10*a* and 11*a*, respectively. A pin 12 serving as spring retainer is secured to the lower extremity, of the left side flat portion 10, while the lower extremity of the rear flat portion 11 is formed with a needle threader attaching portion 13. The plate member 9 is mounted on the gate 3 by two stepped screws 15 by way of an attachment piece 14 having a substantially L shaped cross section, with the flat portions 10 and 11 resting on the left hand side face and rear face of the gate 3 respectively, and is vertically movable within the travel stroke as defined by engagement between the stepped screw 15 and the upper and lower ends of the slot 10*a*.

A metal fitting 16 is secured to the upper portion of the needle bar gate 3 so as to project towards left in FIG. 1 and a tension spring 17 is mounted between the fitting 16 and pin 12 for urging the plate member 9 upwards. Thus, under the force of spring 17, the plate member 9 is normally kept as shown by chain line in FIG. 2 to an elevated position as defined by engagement between the lower end of the slot 10*a* and the stepped screw 15.

Referring to the structure of a needle threader attached to the attaching portion 13 of the plate member 9, a support 18 for the needle threader consists of a metallic plate which is bent so as to have substantially the shape of a letter L when seen in side elevation, with two sides thereof providing a base portion 19 and an arm portion 20 and with one side of said base portion 19 being formed with a bent extension 21.

The support 18 is pivotally mounted to the attaching portion 13 of the plate member 9 at the foremost part of the arm portion 20 by a stepped screw 22 and by the medium of a corrugated spring washer 23. When lowered from the elevated position, the support 9 may be rotated between a retracted position as shown by the chain line in FIG. 1 in which the support 18 is spaced towards the left side of the needle 8 and a threading position as shown by the solid line in FIG. 1 in which the support 18 approaches the needle 8.

An engaging portion 24 is formed by bending the end of the arm portion 20 of the support 18 towards the front for providing retaining means for the support 18 in cooperation with the needle clamp 7, and acts for limiting the rotational extent of the support 18 through engagement with the lower edge or right hand edge of the attaching portion 13. In the threading position of the support 18 as shown by the solid line in FIG. 1, the engaging portion 24 engages the needle clamp 7 from the bottom side for setting and holding the support 18 in the threading position.

Figure 4:
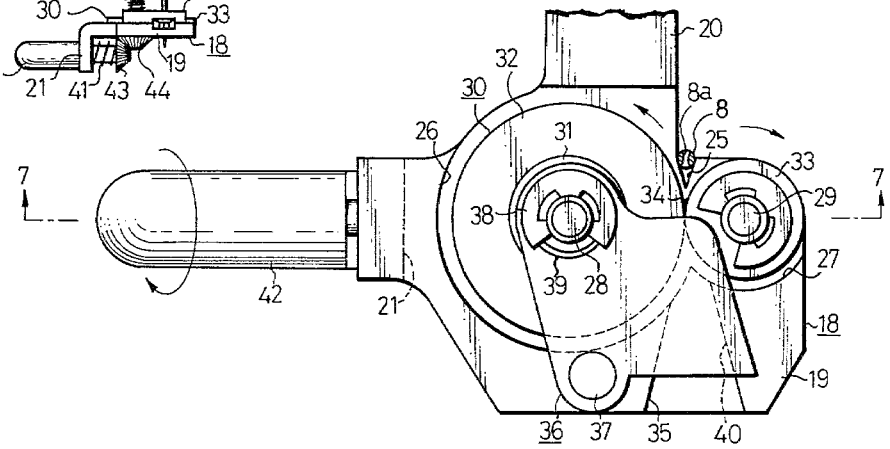
FIG. 4 is an enlarged plan view showing substantial parts of the needle threader.

As shown in FIG. 4, the rear edge of the base portion 19 is formed with a V-shaped needle accommodating notch 25, which is brought to a position close to the needle eye 8*a* of the needle 8 and accommodating the needle 8 when the support 18 has been swung to the threading position. The upper surface of the base portion 19 is formed with a first recess 26 of larger diameter and a second recess 27 of smaller diameter continuous to the first recess 26.

Figure 7:
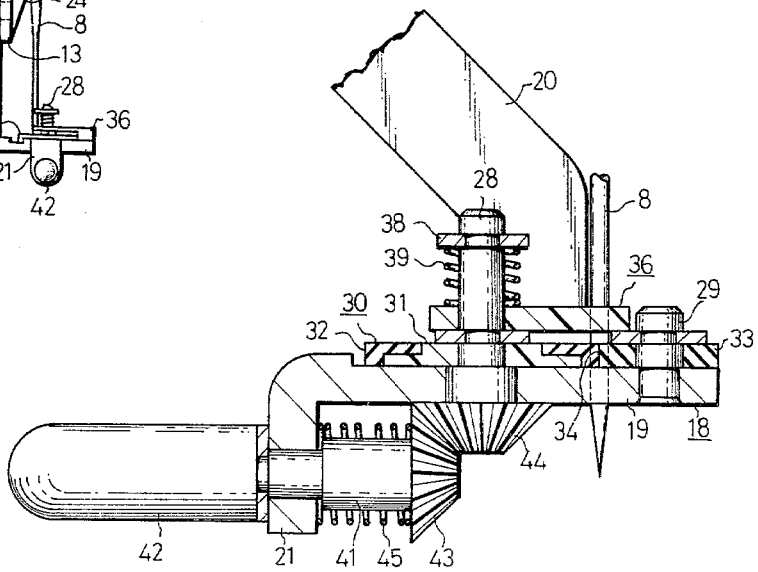
FIG. 7 is a section taken along line 7—7 of FIG. 4.

A rotary shaft 28 is secured to the base portion 19 at the center of the first recess 26 for rotation about its own axis, and a stud 29 is also secured to the base portion 19 at the center of the second recess 27 for extending parallel to said rotary shaft 28. As shown in FIG. 7, a first resilient roller 30 of larger diameter is formed by a disk part 31 made of synthetic material or the like and secured by fitting about the shaft 28 in the first recess 26 and a ring part 32 made of rubber or similar resilient material and fitted about the disk part 31. The first roller 30 is rotatable with rotation of the rotary shaft 28. A second resilient roller 33 made in the form of a ring from rubber or similar resilient material is fitted for rotation about the stud 29 in the second recess 27 and has its outer periphery contacting the outer periphery of said first roller 30 in the vicinity of the notch 25, which is positioned on a tangent line at the contact portion 34.

Figure 5:
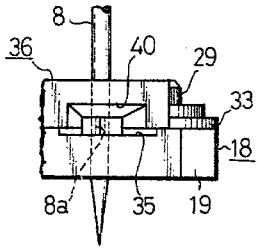
FIG. 5 is a fragmentary plan view shown to an enlarged scale and showing substantial parts of the needle threader.

As shown in FIGS. 4 and 5, the upper surface of the base portion 19 of the support 18 is formed with a thread inserting groove 35 at an opposite side of the notch 25 relative to the contact portion 34 between the pair of resilient rollers 30 and 33. The width of the thread inserting groove 35 is decreased gradually from the front edge of the base portion 19 towards the contact portion 34. A thread guide plate 36 that constitutes thread guide means in cooperation with the thread inserting groove 35 is moulded from transparent synthetic material. The thread guide plate 36 is mounted to a pin 37 secured to the base portion 19 of the support 18 and to said rotary shaft 28 so as to be vertically movable and partially overlie the thread inserting groove 35 and the resilient rollers 30 and 33. A coil spring 39 is mounted between a stop ring 38 mounted to the upper extremity of the rotary shaft 28 and the upper surface of the thread guide plate 36 so that the thread guide plate 36 is normally kept under the spring force of the coil spring 39 in pressure abutment with the upper surface of the base portion 19 and with the upper surface of the first resilient roller 30.

The lower surface of the thread guide plate 36 is formed with a thread inserting groove 40 registrable with the thread inserting groove 35 on the base portion 19.

Figure 6:
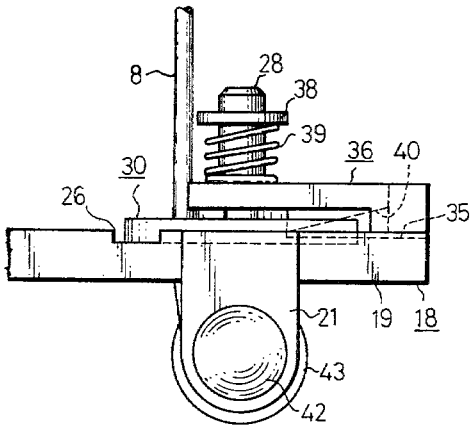
FIG. 6 is a left-hand side view corresponding to FIG. 4.

As shown in FIGS. 5 and 6, the upper surface of the groove 40 is gradually sloped down from the front edge of the thread guide plate 36 towards the contact portion 34 between the resilient rollers 30 and 33 as far as the mid level of thickness of the rollers 30 and 33. By these thread inserting grooves 35 and 40 is defined a thread entrance through which the thread can be readily introduced to a zone close to said contact portion 34.

An operated shaft 41 is mounted on the bent extension 21 of the support 18 perpendicularly to the axis of the rotary shaft 28 so as to be rotatable about and slightly movable along its own axis. A knob portion 42 is mounted to the outer extremity of the operated shaft 41. To the inner extremity of the operated shaft 41 is secured a drive bevel gear 43 meshing with a driven bevel gear 44 secured to the lower end of the rotary shaft 28. A coil spring 45 is mounted between the drive bevel gear 43 and the bent extension 21 for positively bringing the bevel gears 43 and 44 into meshing with each other without play or backlash. By rotational operation of the knob portion 42, the first resilient roller 30 is rotated counterclockwise in FIG. 4 through the drive bevel gear 43 and driven bevel gear 44 and hence the second resilient roller 33 is rotated clockwise in FIG. 4. Thus the thread introduced into the zone close to the contact portion 34 of the rollers 30 and 33 through the thread entrance is transferred as it is gripped between said rollers 30 and 33, and is introduced through the eye 8*a* of the needle 8 accommodated in the notch 25.

The needle threader so far shown and described operates as follows. During normal sewing operation of the sewing machine, the plate member 9 is raised as shown by the chain line in FIG. 1, and the needle threader is kept in the raised position and housed within the face plate 2 so as not to obstruct the sewing operation.

In case of needle threading, the needle 8 is brought to a halt in the raised position by the operator. Then, the face plate 2 is swung for opening the head portion of the machine frame 1 towards left. In this state, the needle threader is pressed down manually, the plate member 9 being thus lowered against the force of the tension spring 17 and the support 18 of the needle threader is moved to a position below the needle clamp 7 mounted on the needle bar 6. Downward travel of the plate member 9 is impeded when the upper edge of the slot 10*a* of the plate member 9 engages with the stepped screw 15. In this state, the support 18 is turned counterclockwise in FIG. 1 by manipulation at the knob portion 42. The needle 8 is flexed slightly towards back against its own resiliency through engagement with the back surface of the base portion 19 of the support 18, and then snaps into the needle accommodating groove 25. Then the manual operation on the threader is released, the plate member 9 and the support 18 are slightly raised under the force of the tension spring 17 until the engaging portion 24 on the support 18 engages the needle clamp 7 from the bottom side, as shown by solid line in FIG. 1.

The spring washer 23 mounted around the stepped screw 22 acts to impart a force of friction to the support 18 for preventing the rotation of the support 18 against the action of tension spring 17 and maintaining the support 18 in the threading position. In this way, the resilient rollers 30 and 33 on the base portion 19 of the support 18 are maintained in the horizontal position as shown in FIGS. 4 through 7 and the eye 8*a* of the needle 8 accommodated in the notch 25 may approach the rear side of the contact portion 34 of the resilient rollers 30 and 33 and be placed on the tangent line passing through the contact portion 34.

Then, the thread is inserted by the operator along the thread entrance defined by the thread inserting grooves 35 and 40, the thread being readily introduced to the zone close to the contact portion 34. Upon rotational operation of the knob portion 42 in the direction of the arrow mark of FIG. 4, the first resilient roller 30 is rotated counterclockwise in FIG. 4 through bevel gears 43 and 44, and hence the second roller 33 is rotated in unison clockwise in FIG. 4. Thus the thread is transferred towards back as it is gripped between the rollers 30 and 33 and may be passed readily and positively through the eye 8*a* of the needle 8.

When the thread thus passed through the eye 8*a* of the needle 8 is then gripped at the end thereof extending towards front from the thread entrance, and is lifted towards back, the thread guide plate 36 is floated against the force of the coil spring 45, the thread being thus released from the thread entrance. After completion of the threading operation as described above, the support 18 is swung clockwise from the threading position shown by the solid line in FIG. 1, the engaging portion 24 being thus released from engagement with the needle clamp 7, and the needle 8 being disengaged from the needle accommodating notch 25. The support 18 is now raised under the force of the tension spring 17 along with the plate member 9 and returned automatically to the original raised position.

If the operator starts the sewing by mistake with the support 18 held in the threading position, the support 18 is forced to be swung clockwise in FIG. 1 through the needle clamp 7 and be retreated from the threading position towards left in FIG. 1, because downward travel of the plate member 9 against the action of the tension spring 17 is obstructed by engagement of the stepped screw 15 with the upper edge of the slot 10*a*. Thus there is no risk of damages done to needle threader components or to the needle to safeguard the operator's safety.

In the present embodiment, since the thread guide plate 36 is made of transparent synthetic material, thread insertion to the zone close to the contact portion 34 of the pair of resilient rollers 30 and 33 may be checked visually. Moreover, since the distal ends of the thread inserting grooves 35 and 40 are located at the mid height of the contact portion 34 of the pair of resilient rollers 30 and 33, the thread introduced to the zone close to the contact portion 34 through the inserting grooves 35 and 40 may be positively gripping by and transferred through rotation of the resilient rollers 30 and 33.

In addition, since the needle accommodating notch 25 on the support 18 is V-shaped in plan view, needles of any thickness may be positively located in the notch 25, it being understood that needles 8 of smaller thickness with smaller eyes 8*a* being positioned closer to the contact portion 34 between the rollers 30 and 33 than the needles of larger thickness.

The present invention is not limited to the specific embodiment described above but may comprise any modifications such as substituting the transparent material of the thread guide plate 36 by opaque or translucent material, changing the plan configuration of the needle accommodating groove 25 to a U-shaped or providing only one thread inserting groove to either the support 18 or the thread guide plate 36, providing that such modifications do not depart from the purport of the invention.

What is claimed is:

1. A needle threader for threading the eye of a needle on a sewing machine with a frame, comprising a support movably mounted on said frame and provided with a needle accommodating notch, a pair of resilient rollers rotatably mounted on said support in the proximity of said notch, and contacting at the respective peripheral edge with each other for gripping the thread therebetween, means disposed between said support and said needle for positioning said support with the tangent line passing through the contact portion of said rollers in alignment with the eye of said needle accommodated in said notch, and thread guide means provided on said support at the opposite side of said notch relative to the contact portion of said rollers, and guiding the insertion of the thread toward the proximity of the contact portion of said rollers, said resilient rollers being rotated to grip and transfer the thread toward the eye of said needle.

2. A needle threader according to claim 1, wherein said thread guide means comprises a thread inserting groove formed on said support, and a thread guide plate mounted on said support for defining a thread entrance in cooperation with said thread inserting groove.

3. A needle threader according to claim 2, wherein said thread guide plate is formed with a thread inserting groove in alignment with said thread inserting groove on said support, and is movably mounted by means of a spring to release the thread inserted into the eye of said needle from said thread entrance.

4. A needle threader according to claim 1, further comprising manual drive means including a knob rotatably mounted on said support and coupled to one of said rollers for rotating said rollers.

* * * * *